US005431297A

United States Patent [19]

Rosello

[11] Patent Number: 5,431,297

[45] Date of Patent: Jul. 11, 1995

[54] POP-UP STRAW FOR BEVERAGE CONTAINERS

[76] Inventor: Agustin A. Rosello, 850 SW. 129th Pl., Apt. 101, Miami, Fla. 33184

[21] Appl. No.: 160,635

[22] Filed: Dec. 2, 1993

[51] Int. Cl.[6] ..... A47G 19/22

[52] U.S. Cl. ..... 220/706; 220/705; 220/710; 215/389; 229/103.1

[58] Field of Search ..... 220/703, 705, 706, 709, 220/710; 229/103.1; 215/1 A

[56] References Cited

U.S. PATENT DOCUMENTS

| | | | |
|---|---|---|---|
| 3,220,587 | 11/1965 | Griffin et al. | 229/103.1 X |
| 3,656,654 | 4/1972 | Brinkley, III | 220/706 |
| 4,109,817 | 8/1978 | Payne et al. | 220/706 |
| 4,228,913 | 10/1980 | Mack et al. | 220/710 |
| 4,709,829 | 12/1987 | Johnson et al. | 220/706 |
| 4,733,785 | 3/1988 | Turner, Jr. et al. | 215/229 |
| 4,877,148 | 10/1989 | Larson et al. | 220/706 |
| 4,930,652 | 6/1990 | Murphy et al. | 220/706 |
| 5,054,639 | 10/1991 | Ahn | 220/706 |
| 5,148,971 | 9/1992 | Ahn | 229/103.1 |
| 5,253,779 | 10/1993 | Lee | 220/705 |

*Primary Examiner*—Allan N. Shoap
*Assistant Examiner*—Vanessa Caretto
*Attorney, Agent, or Firm*—J. Sanchelima

[57] ABSTRACT

A pop-up straw device for containers such as cans and bottles having necks narrower than the body of the bottle. When the device is employed in a can, a vertical guide assembly aligns a telescoping straw assembly with a beverage container's mouth. The telescoping straw assembly includes interior and exterior straws. The interior straw extends out of the mouth of the beverage container once the container is opened. A floater, having a density less than that of the liquid in the container, urges the telescoping straw assembly to protrude out of the container's mouth. In an alternative embodiment, a bracket assembly is mounted to the interior top of the can and aligns the telescoping straw assembly with the mouth of the can. When the device is utilized in a bottle only the floater and the telescoping straw assemblies are required. The walls of the body and neck of the bottle, in conjunction with the floater align the telescoping straw assembly with the mouth of the bottle and the floater is of sufficient rigidity such that it cannot be easily pulled through the mouth of the bottle and thereby prevents the telescoping straw assembly from being pulled completely out of the bottle while at the same time permitting a user to extend the telescoping straw assembly partially out of the bottle.

1 Claim, 5 Drawing Sheets

POP-UP STRAW FOR BEVERAGE CONTAINERS

BACKGROUND OF THE INVENTION

1. Field of the Invention

The present invention relates to straws, and more particularly, to a mechanism to incorporate an extendable straw into a beverage container.

2. Description of the Related Art

Applicant believes that the closest reference corresponds to U.S. Pat. No. 4,733,785 issued to Dan B. Turner, Jr. and Richard Doucet, Jr. This patented invention utilizes a straw that a user can extend from the mouth of a beverage container. However, it differs from the present invention because it cannot be used with cans and bottles because the straw is not aligned with the openings of contemporary soda cans or bottles and may only be used with paper type beverage containers with gabled tops.

Other patents describing the closest subject matter provide for a number of more or less complicated features that fail to solve the problem in an efficient and economical way. None of these patents suggest the novel features of the present invention.

SUMMARY OF THE INVENTION

It is one of the primary objects of the present invention to provide a pop-up straw which can be used with contemporary soda bottles and cans.

It is another objective of the present invention to provide means for a consumer to drink hygienicly from a bottle or can and to provide the convenience of carrying a straw within a bottle or can.

It is yet another object of this present invention to provide such a device that is inexpensive to manufacture and maintain while retaining its effectiveness.

Further objects of the invention will be brought out in the following part of the specification, wherein detailed description is for the purpose of fully disclosing the invention without placing limitations thereon.

BRIEF DESCRIPTION OF THE DRAWINGS

With the above and other related objects in view, the invention consists in the details of construction and combination of parts as will be more fully understood from the following description, when read in conjunction with the accompanying drawings in which.

DETAILED DESCRIPTION OF THE PREFERRED EMBODIMENT

Figure 1B:
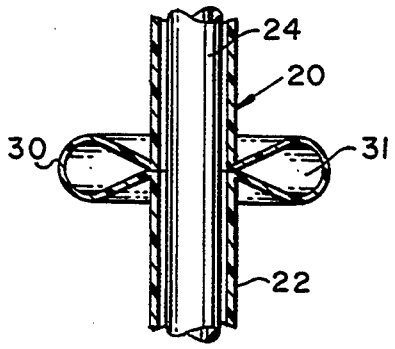
FIG. 1B is a detail view of the floating assembly used with the straw represented in FIGS. 1 and 1A.

Referring now to FIGS. 1, 1A and 1B, 2 and 3C where the present invention for soda cans is generally referred to with numeral 10, it can be observed that it basically includes telescopic straw 20, floater 30 and vertical guide device 40.

It can be seen from FIGS. 1, 1A, 1C and 2 that vertical guide assembly 40 includes vertical guide member 48 and two horizontal guide members, namely upper guide member 42 and lower guide member 44. Telescoping straw assembly 20 is aligned with the beverage container's opening, and cooperatively held in a vertical position, by upper guide member 42 and lower guide member 44.

Figure 3:
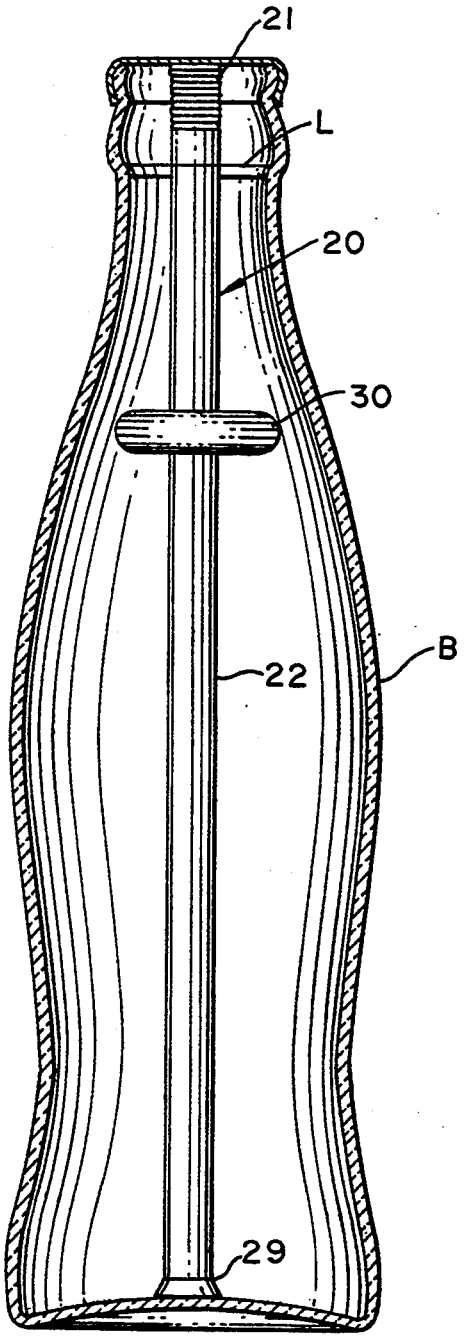
FIG. 3 represents a side elevational view of the present invention contained in an unopened soda bottle.
Figure 3A:
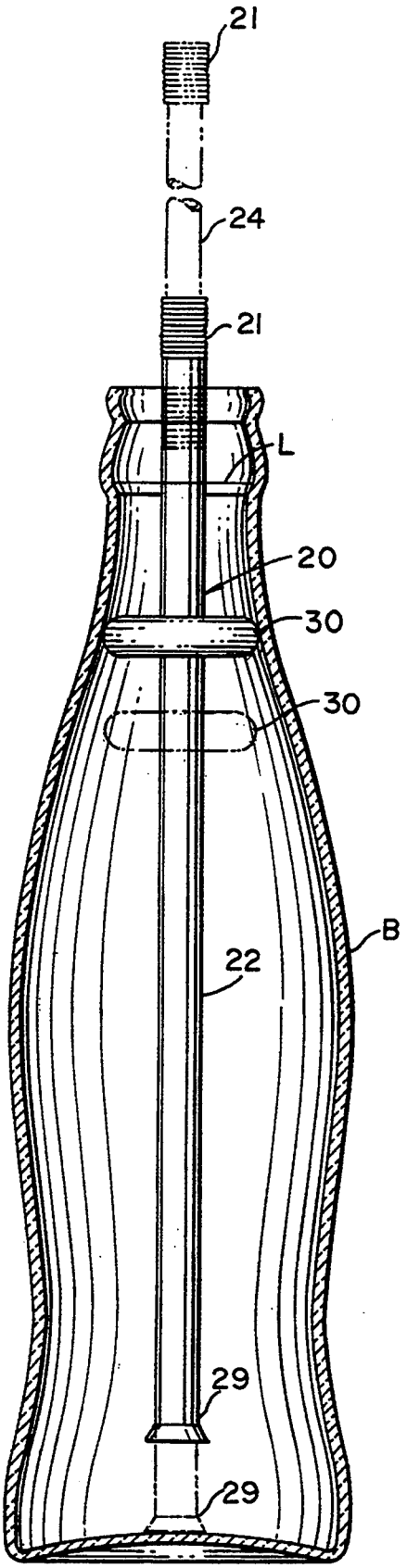
FIG. 3A depicts the invention, shown in FIG. 3, in a soda bottle with the straw telescopically extended.
Figure 3B:
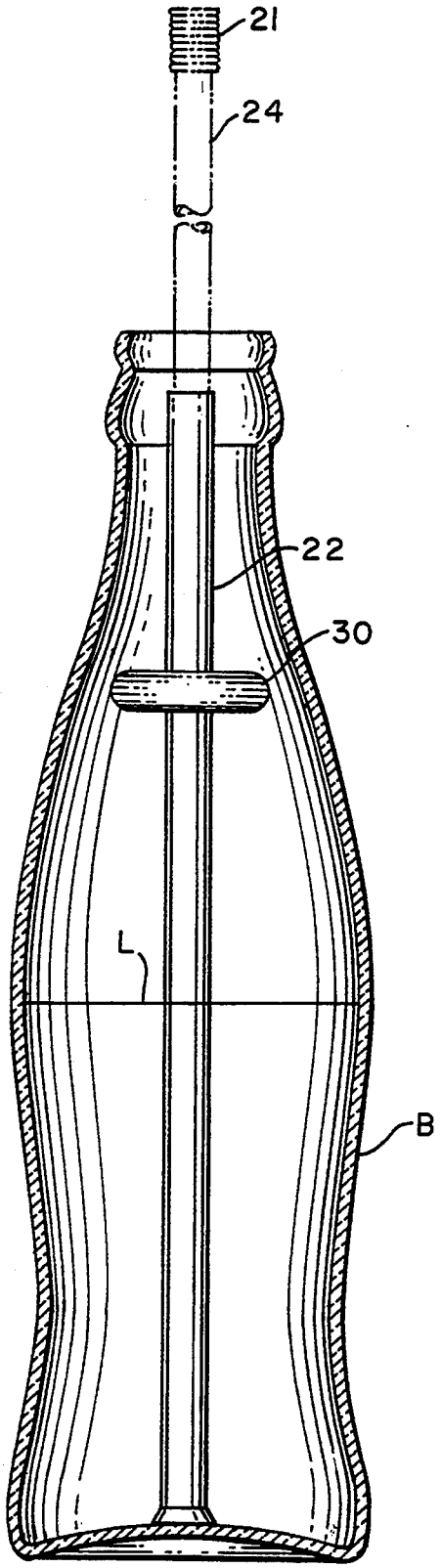
FIG. 3B shows the present invention in an open, partially empty soda bottle.
Figure 3C:
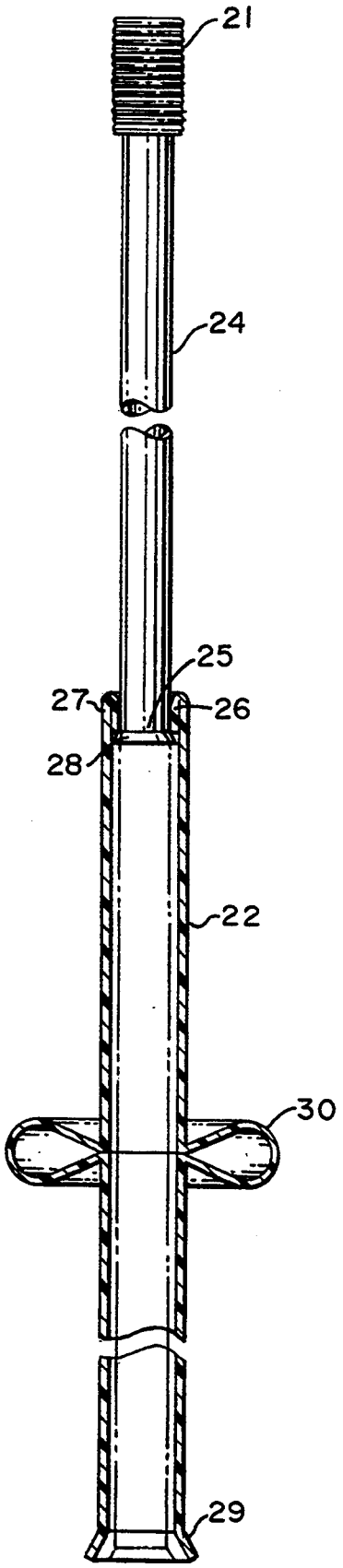
FIG. 3C shows a partial cross-section of the telescopic straw.

As best seen in FIG. 3C, telescopic straw assembly 20 includes exterior straw 22 and interior straw 24. Interior straw 24 is substantially journaled by exterior straw 22. Exterior straw 22 and interior straw 24 having each upper and lower ends. Top end 21 being the end that a user sucks beverage from and bottom end 25 has lip 28. The diameter of lip 28 corresponds substantially to the diameter of exterior straw 22. Interior straw 24 can be withdrawn from exterior straw 22, extending telescoping straw assembly 20 outside can C's mouth. It can also be seen in FIG. 1A that top end 21 has a diameter larger than that of exterior straw 22, this increased diameter prevents top end 21, of interior straw 24, from falling below the level of the upper end 27 of exterior straw 22 and preventing a user from extending interior straw 24 of telescoping straw assembly 20.

Referring again to FIG. 3C, exterior straw 22 has upper end 27 and lower end 29. Restricting ring 26 is integral to the top of upper end 27. Restricting ring 26 has a smaller diameter than lip 28 which prevents interior straw 24 from being completely withdrawn from exterior straw 22. In the preferred embodiment restricting ring 26 is made out of the same material as exterior straw 22 and is formed by exterior straw 22 having its end bent inwardly. Restricting ring 26 adjusts to and conforms to provide a substantially air tight seat for lip 28, thereby ensuring satisfactory suction of liquid L through telescoping straw assembly 20.

Figure 1:
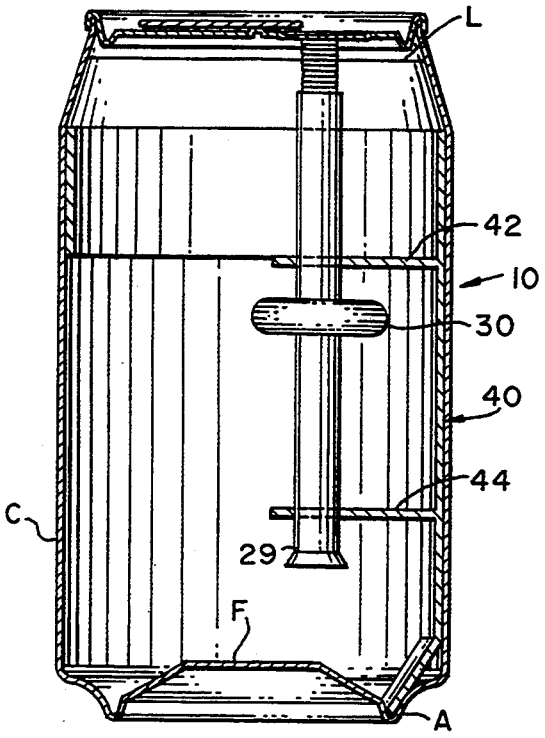
FIG. 1 is a side elevational cross-section view depicting the present invention in a sealed soda can.
Figure 1A:
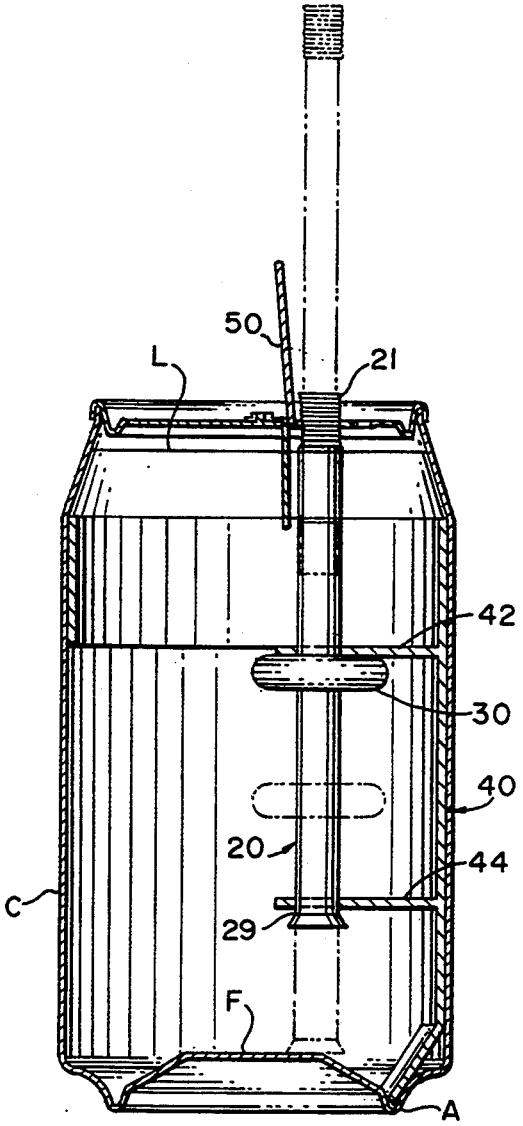
FIG. 1A represents a side elevational cross-sectional view of the device shown in FIG. 1 wherein the tab has been opened and the straw has been pulled out.

It is apparent from FIGS. 1 and 1A that floater 30 is mounted on telescoping straw assembly 20 in an area bounded by upper guide member 42 and lower guide member 44. It can be seen in FIG. 2 that upper and lower guide members 42 and 44 include bays 43 and 45 respectively. Bays 43 and 45 cooperatively and longitudinally coincide with each other to permit exterior straw 22 therethrough.

FIG. 1 depicts the present invention in a sealed soda can. FIG. 1A, illustrates the present invention in an unsealed can C. It can be seen that when a user opens removable tab 50 that floater 30, which is made of a material having a density less than that of the liquid L found in can C, rises upward until floater 30 abuts upper guide member 42. Telescopic straw assembly 20 is shown in phantom in its extended position in FIG. 1A. It can be seen in FIG. 1B that floater 30 has space 31 which urges floater 30 upward.

Figure 1C:
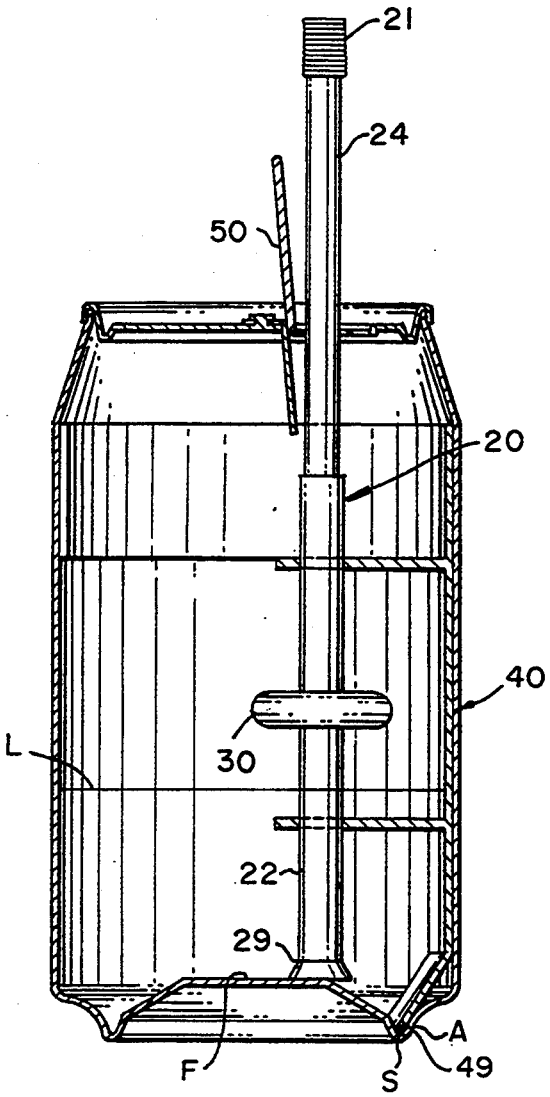
FIG. 1C is a side elevational cross-section view of the present invention used in a soda can wherein the straw has been telescopically extended and the level of the liquid is below the floater.

Referring now to FIG. 1C wherein it can be observed that as liquid L is consumed floater 30, which has a density less than that the liquid L contained in can C, is no longer is supported by the liquid L and does not urge telescopic straw assembly 20 upward. When the level of liquid L in can C falls below the minimum height of floater 30 telescopic straw assembly 20 falls and end 29 comes into contact with floor F of can C.

Figure 2:
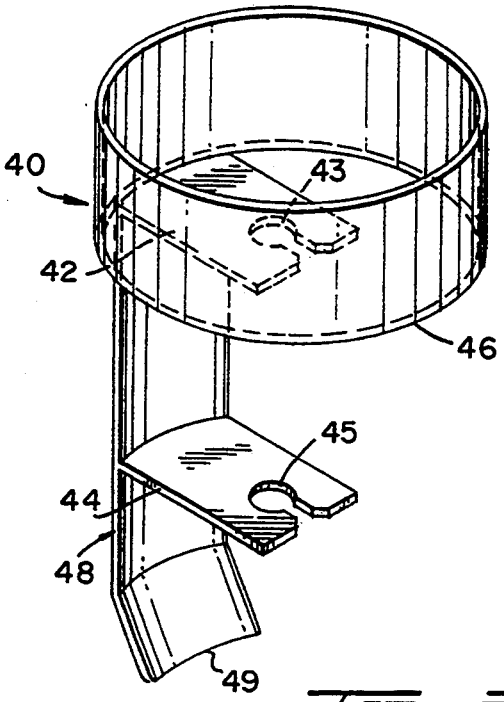
FIG. 2 depicts an isometric view of the present invention's vertical guide assembly as used in a soda can.

Referring now to FIG. 2 it can be seen that vertical guide assembly 40 includes ring 46, upper guide member 42, lower guide member 44 and vertical guide member 48. Ring 46 is slightly smaller than the internal diameter of can C and it is cooperatively and snugly received by can C. Upper guide member 42 and lower guide member 44 are mounted in a parallel and spaced apart relationship with respect to each other on vertical guide member 48 and cooperatively align telescopic straw assembly 20 with the mouth of can C. End 49 of vertical guide member 48 is inserted inside the internal space S defined by annular base A of can C. The combination of ring 46 and end 49 provides the mechanical integrity which keeps vertical guide assembly 40 in place.

Referring now to FIGS. 3, 3A, 3B and 3C, it can be seen an alternative embodiment of the present invention can be used in a soda bottle. When pop-up straw for beverage container device 10 is used in a soda bottle B vertical guide assembly 40, as is used with can C, is not required. It is apparent from FIG. 3 that telescoping straw assembly 20 includes exterior straw 22 and interior straw 24. Interior straw 24 having an upper and lower end. The top end 21 being the end that a user sucks beverage from and the bottom end 25 having a lip 28 which provides the inlet for liquid L. The diameter of lip 28 corresponds substantially to the diameter of exterior straw 22. In addition, interior straw 24 can be partially withdrawn from exterior straw 22. In the preferred embodiment, as seen in FIG. 3C, ring 26 is made out of the same material as exterior straw 22 and is formed by exterior straw 22 having its end bent inwardly. Restricting ring 26 has a smaller inner diameter than lip 28 preventing interior straw 24 from being pulled out of, and separated from, exterior straw 22. In addition, top end 21 has a diameter larger than that of exterior straw 22, this prevents interior straw 24 from sliding completely inside exterior straw 22 and preventing a user from pulling interior straw 24 out of exterior straw 22. Floater 30 is rigidly mounted to exterior straw 22 at a predetermined position such that top end 21 protrudes outwardly through the mouth of bottle B, preferably approximately one and one half centimeters.

FIG. 3A depicts floater 30, which has a density less that than that of the beverage contained in bottle B, urging telescoping straw 20 towards bottle B's mouth. It is apparent from FIG. 3A that floater 30 urges telescoping straw assembly 20 upward from the position shown in phantom until floater 30 abuts the walls of bottle B. Floater 30 prevents device 10 from passing through bottle B's mouth. Floater 30 is made from a flexible material so that it can be inserted into bottle B with the application of a predetermined amount of force. This predetermined amount of force is sufficient to prevent floater 30 from being accidentally pulled out by a user during normal consumption.

When the level of liquid L falls below a predetermined level, as best seen in FIG. 3B, floater 30 does not urge telescoping straw assembly 20 towards bottle B's mouth.

Figure 4C:
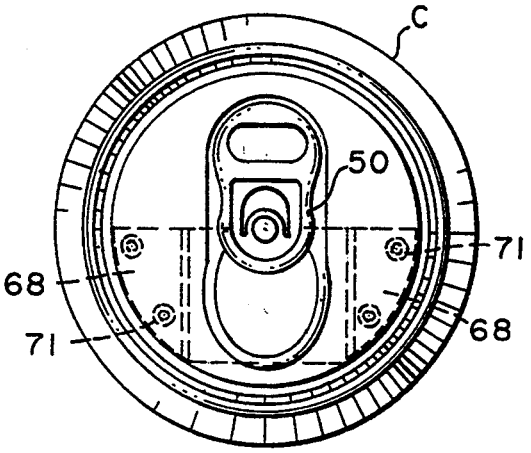
FIG. 4C is a top view of the can shown in FIG. 4.
Figure 4B:
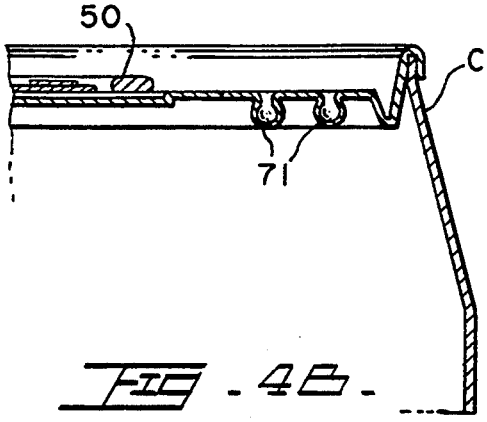
FIG. 4B is a partial detailed view of the inverted dimples used to fasten the bracket assembly found in FIGS. 4 and 4A to a soda can.
Figure 4:
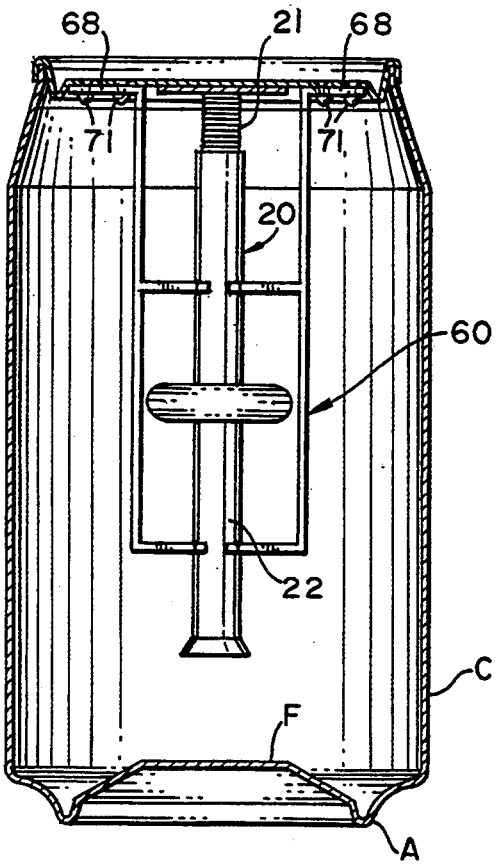
FIG. 4 is a cross sectional elevational view of an unopened soda can with an alternate embodiment of the bracket assembly for the present invention mounted to the inner surface of the top of the can.
Figure 4A:
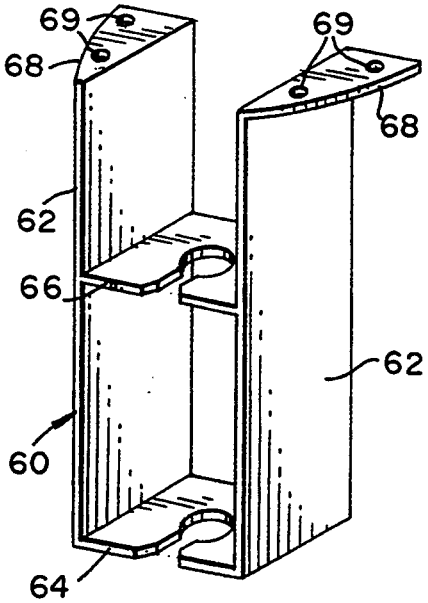
FIG. 4A shows an isometric view of the bracket assembly found in FIG. 4.

Referring now to FIGS. 4, 4A and 4B, which depict an alternate embodiment of the present invention employed in a can C. The alternate embodiment depicted in FIGS. 4, 4A and 4B is used in cans C and utilizes bracket assembly 60 to secure telescoping straw assembly 20 to the top of can C. Bracket assembly 60 includes walls 62, bottom guide 64, top guide 66, clips 68 and holes 69. Bottom guide member 64 and top guide member 66 cooperatively align telescoping straw assembly 20 so that top end 21 of straw 20 coincides with the mouth of can C. Additionally, walls 62 cooperatively secure bottom guide member 64 and top guide member 66 in a spaced apart vertical relationship.

As best seen in FIGS. 4A and 4B, it can be observed that bracket assembly 60 also includes clips 68. Clips 68 removably fasten bracket assembly 60 to the top of can C. Holes 69 of clips 68 receive inverted dimples 71, thereby removably mounting bracket assembly 60 to the top of can C. As best seen in FIG. 4B and 4C, inverted dimples 71 are integral with the top of can C.

The foregoing description conveys the best understanding of the objectives and advantages of the present invention. Different embodiments may be made of the inventive concept of this invention. It is to be understood that all matter disclosed herein is to be interpreted merely as illustrative, and not in a limiting sense.

What is claimed is:

1. A pop up straw device for a beverage can having a top with a removable tab and said can further including an annular base defining an internal space therein, comprising:

A. a straw assembly having interior and exterior straw members coaxially and telescopically mounted with respect to each other;

B. straw guiding means mounted to the interior of said can and adapted to guide staid straw assembly coaxially within said can to coincide with said removable tab, said straw guiding means includes an upper guide member, a lower guide member and a vertical guide member, said upper and lower guide members being kept in a spaced apart and parallel relationship with respect to each other and mounted to said vertical guide member, said upper and lower guide members guiding said straw assembly coaxially within said can to coincide with said removable tab and the resulting opening after its removal and said guiding means further including ring means for keeping said vertical guide member coaxially disposed within said can; and C. float means mounted to said exterior straw to urge said straw assembly against said tab and constructed to cooperate with said straw guiding means to prevent said straw assembly from being pulled out more than a predetermined distance when said interior straw member is pulled out by a user, and said floating means being mounted at a predetermined position that falls between said upper and lower guide members so that when a user pulls out said straw assembly the interior straw is allowed to slide out of the exterior straw member by stopping the movement of the latter.

* * * * *